US009180687B2

(12) United States Patent
Kawabata et al.

(10) Patent No.: US 9,180,687 B2
(45) Date of Patent: Nov. 10, 2015

(54) FILTER MANUFACTURING APPARATUS AND FILTER MANUFACTURING METHOD

(75) Inventors: Motonobu Kawabata, Kyoto (JP); Toru Kawada, Kyoto (JP); Kazushi Kibune, Kyoto (JP); Takaharu Yamamoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 892 days.

(21) Appl. No.: 13/437,603

(22) Filed: Apr. 2, 2012

(65) Prior Publication Data

US 2012/0249653 A1 Oct. 4, 2012

(30) Foreign Application Priority Data

Mar. 31, 2011 (JP) ..... 2011-079626

(51) Int. Cl.
*B41J 3/407* (2006.01)
*B41J 2/045* (2006.01)

(52) U.S. Cl.
CPC ..... *B41J 3/407* (2013.01); *B41J 2/04505* (2013.01); *B41J 2/04573* (2013.01); *B41J 2/04586* (2013.01)

(58) Field of Classification Search
USPC ..... 347/2–4, 16, 106; 427/466
See application file for complete search history.

(56) References Cited

U.S. PATENT DOCUMENTS

| | | | | |
|---|---|---|---|---|
| 5,984,470 | A * | 11/1999 | Sakino et al. | 347/106 |
| 6,244,702 | B1 * | 6/2001 | Sakino et al. | 347/106 |
| 6,874,883 | B1 | 4/2005 | Shigemura et al. | |
| 2006/0093751 | A1 * | 5/2006 | White et al. | 427/466 |

FOREIGN PATENT DOCUMENTS

JP 9-138306 A 5/1997

* cited by examiner

*Primary Examiner* — Lam Nguyen
(74) *Attorney, Agent, or Firm* — McDermott Will & Emery LLP

(57) ABSTRACT

A filter manufacturing apparatus includes a printing cell setting unit that sets, based on a predetermined filter pitch and a head resolution, printing cells having an equal number of dot areas in the direction perpendicular to the transport direction of the printing medium, a shift amount calculating unit that calculates shift amounts between the filter pitch and the printing cells in the direction perpendicular to the transport direction of the printing medium, a shift amount determining unit that determines whether shift amounts of the printing cells exceed a unit dot area; and a printing cell complementing unit that complements the shift amounts of the printing cells exceeding the unit dot area by adjusting the number of dot areas included in the printing cells.

20 Claims, 8 Drawing Sheets

FILTER MANUFACTURING APPARATUS AND FILTER MANUFACTURING METHOD

BACKGROUND OF THE INVENTION (1) Field of the Invention

This invention relates to a filter manufacturing apparatus and a filter manufacturing method, and more particularly to a technique of manufacturing color filters by inkjet printing for use in liquid crystal displays or electronic paper.

(2) Description of the Related Art

Conventionally, there is a manufacturing method by photolithography as a method of manufacturing liquid crystal color filters. Manufacturing color filters by photolithography can provide filters with high quality in positional precision. However, this requires numerous steps such as mask baking, cleaning and chemical treatment for each filter color.

So, research has been made on a method of manufacturing color filters by inkjet printing in recent years. Compared with photolithography, inkjet printing can reduce manufacturing steps and can manufacture filters at low cost. Patent Document 1 (Japanese Unexamined Patent Publication H9-138306), for example, discloses an apparatus for manufacturing color filters using an inkjet apparatus of the one-pass type.

However, the conventional example with such construction has the following problems. The nozzle pitch of the inkjet head is standardized in the industry, and the arrangement pitch of filters does not usually agree with the nozzle pitch. In order to set the arrangement pitch of filters to positions of an integral multiple of the nozzle pitch, the inkjet head is inclined to match the cosine component of the nozzle pitch with the arrangement pitch of filters. In this case, it is necessary to adjust printing timing of each nozzle individually, which makes control complicated. An angle of inclination of the inkjet head must be changed whenever the filter pitch of a printing medium is changed, which requires a time-consuming adjustment.

SUMMARY OF THE INVENTION

This invention has been made having regard to the state of the art noted above, and its object is to provide a filter manufacturing apparatus and a filter manufacturing method for manufacturing filters without inclining an inkjet head.

The above object is fulfilled, according to a first aspect of this invention, by a filter manufacturing apparatus for manufacturing, by inkjet printing, filters arranged at intervals in a transport direction of a printing medium and in a direction perpendicular to the transport direction, the apparatus comprising a printing cell setting unit for setting, based on a predetermined filter pitch and a head resolution, printing cells having an equal number of dot areas in the direction perpendicular to the transport direction of the printing medium; a shift amount calculating unit for calculating shift amounts between the filter pitch and the printing cells in the direction perpendicular to the transport direction of the printing medium; a shift amount determining unit for determining whether shift amounts of the printing cells exceed a unit dot area; and a printing cell complementing unit for complementing the shift amounts of the printing cells exceeding the unit dot area by adjusting the number of dot areas included in the printing cells.

According to the invention described above, printing cells having an equal number of dot areas in the direction perpendicular to the transport direction of the printing material are set based on a filter pitch and a head resolution. Shift amounts between the filter pitch and the printing cells, and whether shift amounts of the printing cells exceed a unit dot area is determined. For the printing cells including shift amounts exceeding the unit dots area, the shift amounts are complemented by adjusting the number of dot areas included in the printing cells. Consequently, even if the filter pitch and head resolution are not in agreement, shifts of the filter pitch can be made smaller than the head resolution. Filters can be manufactured with high filter pitch accuracy by inkjet printing without inclining inkjet heads.

A preferred example of the filter manufacturing apparatus further comprises a complementary printing pattern creating unit for creating a complementary printing pattern corresponding to the printing cells complemented by the printing cell complementing unit from a predetermined printing pattern to be ejected in the printing cells; and a printing pattern setting unit for allocating the printing pattern to the printing cells and allocating the complementary printing pattern to the complemented printing cells.

With the above construction, by setting the printing pattern to the set printing cells, when a gray scale head is used, a proper ink quantity can be discharged to proper discharge positions, thereby to reduce the number of times of discharge. Also when the complementary printing pattern creating unit creates the complementary printing pattern corresponding to the complemented printing cells, adjustment can be made to a proper ink quantity to be discharged to proper discharge positions, thereby to print filters appropriately according to the size of the printing cells.

In a preferred example of the filter manufacturing apparatus, the complementary printing pattern creating unit is arranged to create the complementary printing pattern by reducing non-ejection dot areas in the printing pattern. With this construction, since the complementary printing pattern is created by reducing the non-ejection dot areas in the printing pattern, density variations of a filter color between printing pattern not complemented and printing pattern complemented can be inhibited.

In a preferred example of the filter manufacturing apparatus, the complementary printing pattern is an asymmetrical pattern. This construction employs an asymmetrical pattern as the complementary printing pattern. Since it has an irregular printing pattern in the arrangement of filters, pitch unevenness can be reduced.

In a preferred example of the filter manufacturing apparatus, the complementary printing pattern creating unit is arranged to create plural types of complementary printing pattern; and the printing pattern setting unit is arranged to allocate at random the plural types of complementary printing pattern to the complemented printing cells. With this construction, plural types of printing pattern are printed at random as complementary printing patterns. With irregular printing patterns in the arrangement of filters, pitch unevenness can be reduced.

In a preferred example of the filter manufacturing apparatus, the printing pattern has ejection dot areas on diagonal lines in the printing cells. With this construction, the printing pattern has ejection dot areas on diagonal lines in the printing cells, which enables ejected ink to be efficiently diffused within the printing cells.

A second aspect of this invention provides a filter manufacturing method for manufacturing, by inkjet printing, filters arranged at intervals in a transport direction of a printing medium and in a direction perpendicular to the transport direction, the method comprising a printing cell setting step for setting, based on a predetermined filter pitch and a head resolution, printing cells having an equal number of dot areas in the direction perpendicular to the transport direction of the printing medium; a shift amount calculating step for calculating shift amounts between the filter pitch and the printing cells in the direction perpendicular to the transport direction of the printing medium; a shift amount determining step for determining whether shift amounts of printing cells exceed a unit dot area; and a printing cell complementing step for complementing the shift amounts of the printing cells exceeding the unit dot area by adjusting the number of dot areas included in the printing cells.

According to this method, printing cells having an equal number of dot areas in the direction perpendicular to the transport direction of the printing medium are set based on a filter pitch and a head resolution. Shift amounts between the filter pitch and the printing cells, and whether shift amounts of the printing cells exceed a unit dot area is determined. For the printing cells including shift amounts exceeding the unit dots area, the shift amounts are complemented by adjusting the number of dot areas included in the printing cells. Consequently, even if the filter pitch and head resolution are not in agreement, shifts of the filter pitch can be made smaller than the head resolution. Filters can be manufactured with high filter pitch accuracy by inkjet printing without inclining inkjet heads. Since the inkjet heads are not inclined, the method can be used effectively where nozzle openings are arranged in a plurality of rows.

A preferred example of the filter manufacturing method further comprises a complementary printing pattern creating step for creating a complementary printing pattern corresponding to the printing cells complemented by the printing cell complementing step with a predetermined printing pattern to be ejected in the printing cells; and a printing pattern setting step for allocating the printing pattern to the printing cells and allocating the complementary printing pattern to the complemented printing cells.

With the above method, by setting the printing pattern to the set printing cells, when a gray scale head is used, a proper ink quantity can be discharged to proper discharge positions, thereby to reduce the number of times of discharge. Also when the complementary printing pattern creating step creates the complementary printing pattern corresponding to the complemented printing cells, adjustment can be made to a proper ink quantity to be discharged to proper discharge positions, thereby to print filters appropriately according to the size of the printing cells.

In a preferred example of the filter manufacturing method, the complementary printing pattern creating step is executed to create the complementary printing pattern by reducing non-ejection dot areas in the printing pattern. With this method, since the complementary printing pattern is created by reducing the non-ejection dot areas in the printing pattern, density variation of a filter color between printing pattern not complemented and printing pattern complemented can be inhibited.

In a preferred example of the filter manufacturing method, the complementary printing pattern is an asymmetrical pattern. This method employs an asymmetrical pattern as the complementary printing pattern. Since it has an irregular printing pattern in the arrangement of filters, pitch unevenness can be reduced.

In a preferred example of the filter manufacturing method, the complementary printing pattern creating step is executed to create plural types of complementary printing pattern; and the printing pattern setting step is executed to allocate at random the plural types of complementary printing pattern to the complemented printing cells. With this method, plural types of printing pattern are printed at random as complementary printing patterns. With irregular printing patterns in the arrangement of filters, pitch unevenness can be reduced.

In a preferred example of the filter manufacturing method, the printing pattern has ejection dot areas on diagonal lines in the printing cells. With this method, the printing pattern has ejection dot areas on diagonal lines in the printing cells, which enables ejected ink to be efficiently diffused within the printing cells.

According to the filter manufacturing apparatus and filter manufacturing method of this invention, even if the filter pitch and head resolution are not in agreement, shifts of the filter pitch can be made smaller than the head resolution. Filters can be manufactured with high filter pitch accuracy by inkjet printing without inclining inkjet heads.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
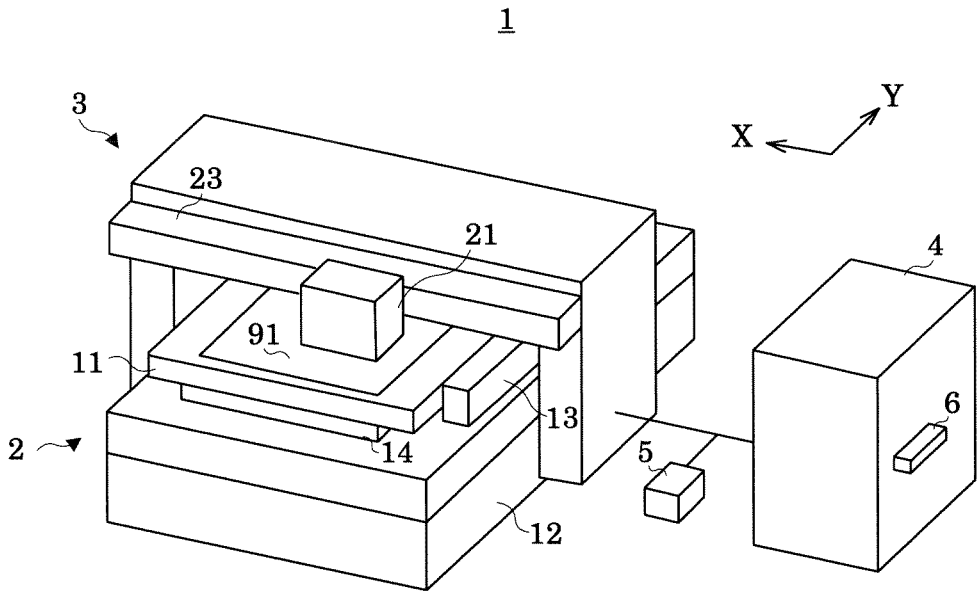
FIG. 1 is an overall perspective view of a filter manufacturing apparatus according to this invention.

Embodiments of this invention will be described hereinafter with reference to the drawings. FIG. 1 is an overall outline view of a filter manufacturing apparatus.

1. Filter Manufacturing Apparatus

A filter manufacturing apparatus 1 manufactures color filters on a base material 91 by inkjet printing. This embodiment employs and describes an inkjet printing machine of the multipass type. The base material 91 may be a glass substrate, or may be paper with a coating agent applied thereto. The base material 91 corresponds to the printing medium in this invention.

The filter manufacturing apparatus 1 includes a transport mechanism 2 for transporting the base material 91, a print head 3 for ejecting UV curable inks onto the base material 91 being transported, a controller 4 for controlling transport timing of the base material 91 and ink ejection timing of the print head 3, and an image data creator 5 for creating image data corresponding to areas to which inks are ejected, and an input unit 6 for inputting various condition settings.

The transport mechanism 2 has a stage 11 for holding the base material 91, a base block 12 on which the stage 11 is placed, a position detector 13 mounted on the base block 12 for detecting positions of the stage 11 relative to the base block 12, and a stage drive 14 for moving the stage 11 forward or backward in a transport direction.

The print head 3 has a discharger 21 for discharging the inks, and a discharger transport mechanism 23 for moving the discharger 21 in directions perpendicular to the transport direction of the base material 91.

Figure 2:
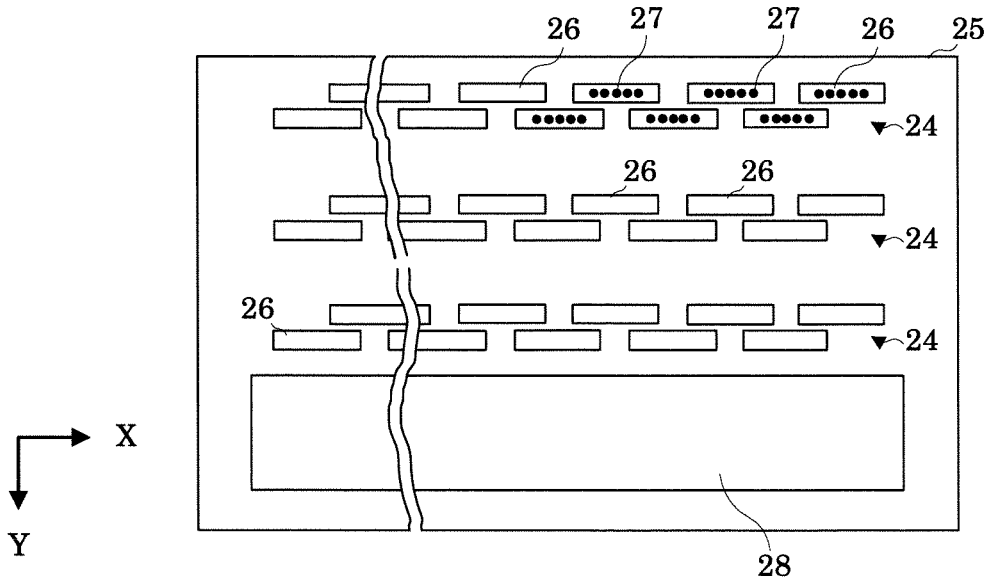
FIG. 2 is a bottom plan view of a discharger.

Next, reference is made to FIG. 2. FIG. 2 is a bottom plan view of the discharger 21. The discharger 21 has a plurality of head units 24 for discharging inks of different color components. The head units 24 are fixed to a body 25 of the discharger 21 in an arrangement in a (+Y) direction which is a reverse transport direction of the base material 91. In the order from the head unit 24 foremost in the (+Y) direction toward the head unit 24 on the (−Y) side in FIG. 2, the head units 24 discharge R (red), G (green) and B (blue) inks. Each ink includes an ultraviolet curing agent to be UV curable.

Each head unit 24 has a plurality of heads 26 of the piezo drive type, for example, arranged zigzag in X-direction (hereinafter called the "width direction") perpendicular to the transport direction of the base material 91. Each head 26 has a plurality of nozzles 27 arranged in the width direction on a lower surface thereof for discharging minute ink droplets. The nozzles 27 are depicted only on some heads 26. Consequently, each head unit 24 as a whole has a plurality of nozzles 27 arranged at a constant pitch in the width direction, to be able to form a plurality of dots aligned in the width direction on the base material 91, in each position in a scan direction of the discharger 21. Although the plurality of head units 24 are provided on the discharger 21 in this embodiment, the discharger 21 may be provided with one head unit 24 for each color.

The discharger 21 includes an emission unit 28 disposed on the (+Y) side of the plurality of the head units 24 and connected to a light source which generates ultraviolet light. The light source is provided rearward of the discharger 21. The emission unit 28 has a plurality of optical fibers arranged in X-direction. Thus, the emission unit 28 emits ultraviolet light to linear areas extending in X-direction on the base material 91.

In a printing operation, the UV curable inks are discharged while the base material 91 is transported in (−Y) direction relative to the discharger 21, and the inks are cured immediately after discharge on the base material 91 by the ultraviolet light emitted from the emission unit 28 to the inks. Thus, in the filter manufacturing apparatus 1, the light source 22 and the emission unit 28 act as a curing device for curing the inks. At the time of printing, whenever movement of the base material 91 is repeated, the discharger 21 moves in X-direction. That is, the transport mechanism 2 and discharger moving mechanism 23 act as mechanisms for moving the discharger 21 relative to the base material 91 in parallel with the discharge of the inks from the discharger 21. Printing is carried out in an interlace mode. After a color ink is once discharged to a position, the ink may be repeatedly discharged to the same position to improve printing density of the color ink. A one-pass mode may be employed, in which the nozzles 27 are arranged at a sufficiently small pitch, and printing is completed with the base material 91 moved once in (−Y) direction relative to the discharger 21.

With another emission unit 28 provided on the most (−Y) side of the plurality of head units 24, printing may be carried out by reciprocating the base material 91 in (−Y) direction and (+Y) direction while discharging ink droplets. While UV curable inks are employed in this embodiment, solvent inks may be employed instead. When employing solvent inks, the inks are dried naturally or by using a heater or heaters.

2. Image Data Creator

Figure 3:
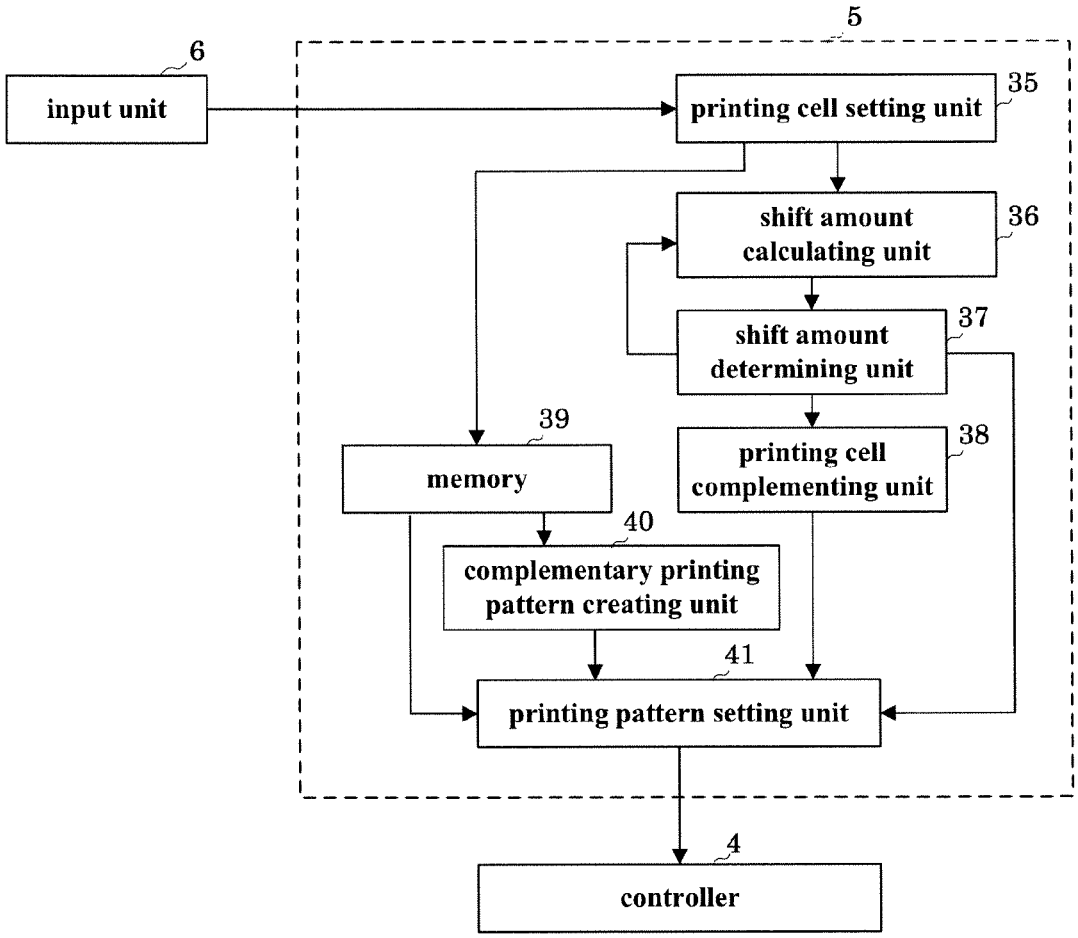
FIG. 3 is a block diagram showing a construction of an image data creator.
Figure 4:
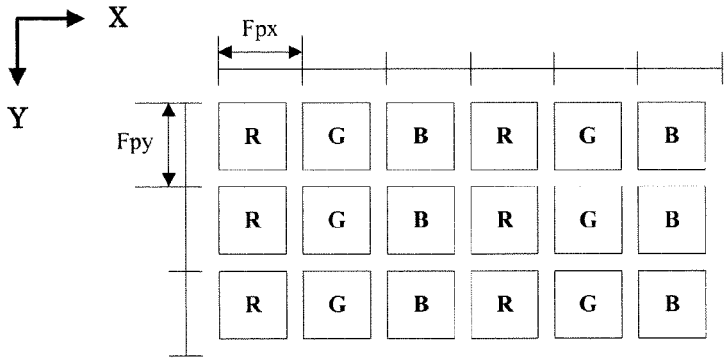
FIG. 4 is an explanatory view showing an arrangement of color filters.

Next, a construction of the image data creator 5 will be described with reference to FIGS. 3 and 4. FIG. 3 is a block diagram showing a construction of the image data creator, and FIG. 4 is an explanatory view showing an arrangement of color filters manufactured. In FIG. 4, R represents red filters, G green filters and B blue filters. Each of the R, G and B filters is square. The R, G and B filters may be rectangle, instead of being square. The filters are arranged at a filter pitch Fpx in the width direction, and at a filter pitch Fpy in the transport direction. The arrangement of the color filters is not limited to what is shown, but may be otherwise.

The image data creator 5 creates image data for the color filters based on the arrangement pitch of the color filters and the pitch of the nozzles 27. The image data creator 5 includes a printing cell setting unit 35 for setting printing cells having an equal number of dot areas in the direction (X-direction) perpendicular to the transport direction of the base material 91 based on a filter pitch and a head resolution inputted to the input unit 6, a shift amount calculating unit 36 for calculating shift amounts between the filter pitch and printing cells in the direction perpendicular to the transport direction of the base material 91, a shift amount determining unit 37 for determining whether shift amounts of the printing cells exceed a unit dot area or not, a printing cell complementing unit 38 for complementing the shift amounts of the printing cells exceeding the unit dot area by adjusting the number of dot areas included in the printing cells.

The image data creator 5 further includes a memory unit 39 storing a predetermined printing pattern to be ejected in the printing cells, a complementary printing pattern creating unit 40 for creating complementary printing patterns corresponding to the printing cells complemented by the printing cell complementing unit 38 from the predetermined printing pattern to be ejected to the printing cells, a printing pattern setting unit 41 for allocating the printing pattern to the printing cells and allocating the complementary printing patterns to the complemented printing cells. The image data creator 5 is constructed of a microprocessor and memory, but may be part of the CPU of the controller 4.

The printing cell setting unit 35 virtually sets printing cells Pc based on the filter pitch Fpx in X-direction and the filter pitch Fpy in Y-direction. Particularly in X-direction perpendicular to the transport direction of the base material 91, printing cells Pc are set, based on the filter pitch Fpx and the head resolution of the head units 24, to have an equal number of dot areas. The filter pitch Fpx and filter pitch Fpy have predetermined values inputted to the input unit 6 by the operator.

The head resolution means a minimum printing pitch Pm in the width direction, which in this embodiment is 2400 dpi. When nozzle pitch Np is 300 dpi, for example, 2400 dpi can be printed by scanning eight times in the width direction in the multipass mode. In the case of the one-pass mode, it can be attained by providing eight head units of the same color and shifting the head units in the width direction. The minimum printing pitch Pm in this embodiment is 10.58 μm. Areas formed at the minimum printing pitch Pm are considered the dot areas. In this embodiment, areas of 10.58 μm square are made the dot areas.

Figure 5:
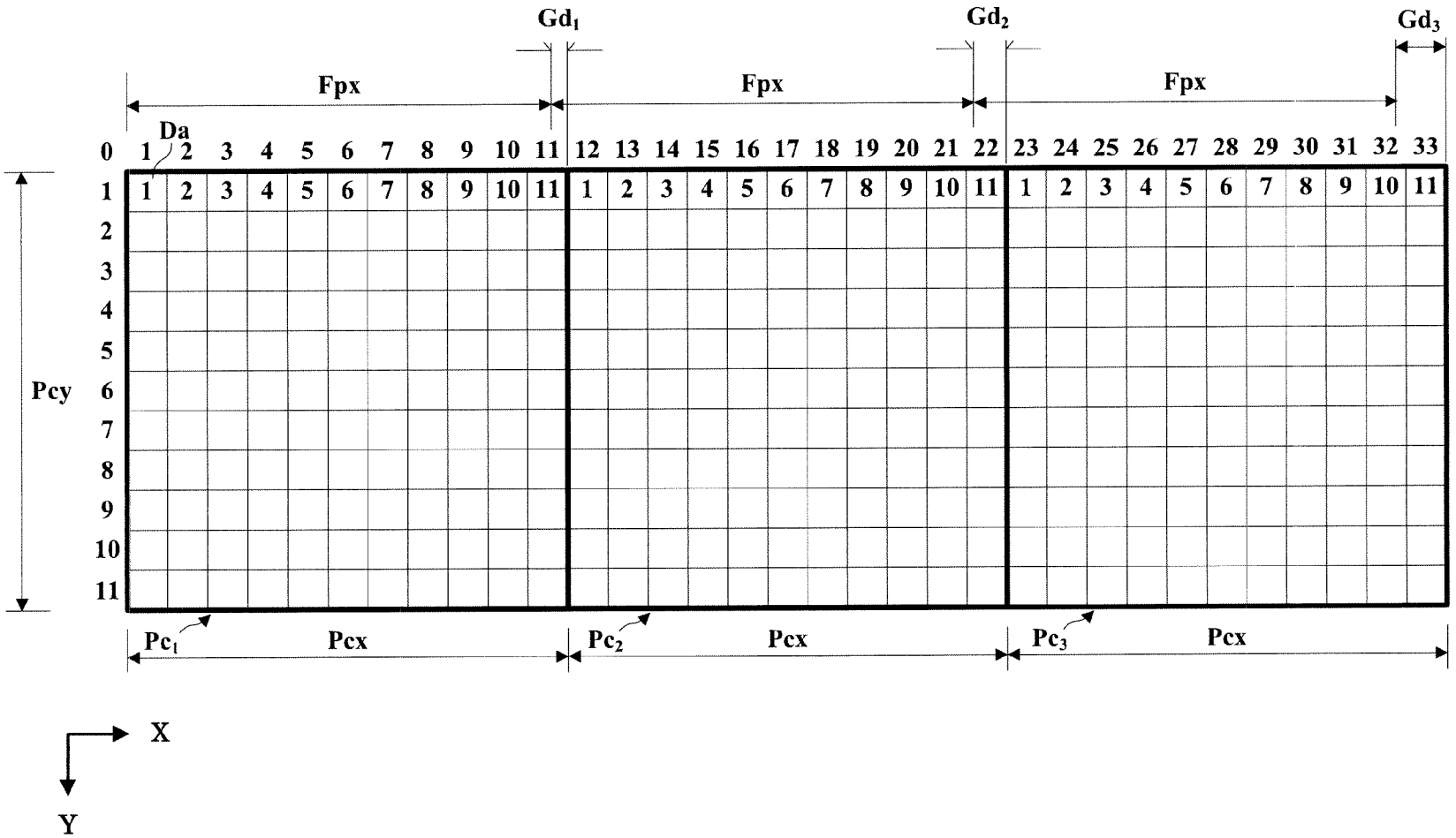
FIG. 5 is an explanatory view showing an arrangement of printing cells relative to a filter pitch.
Figure 6:
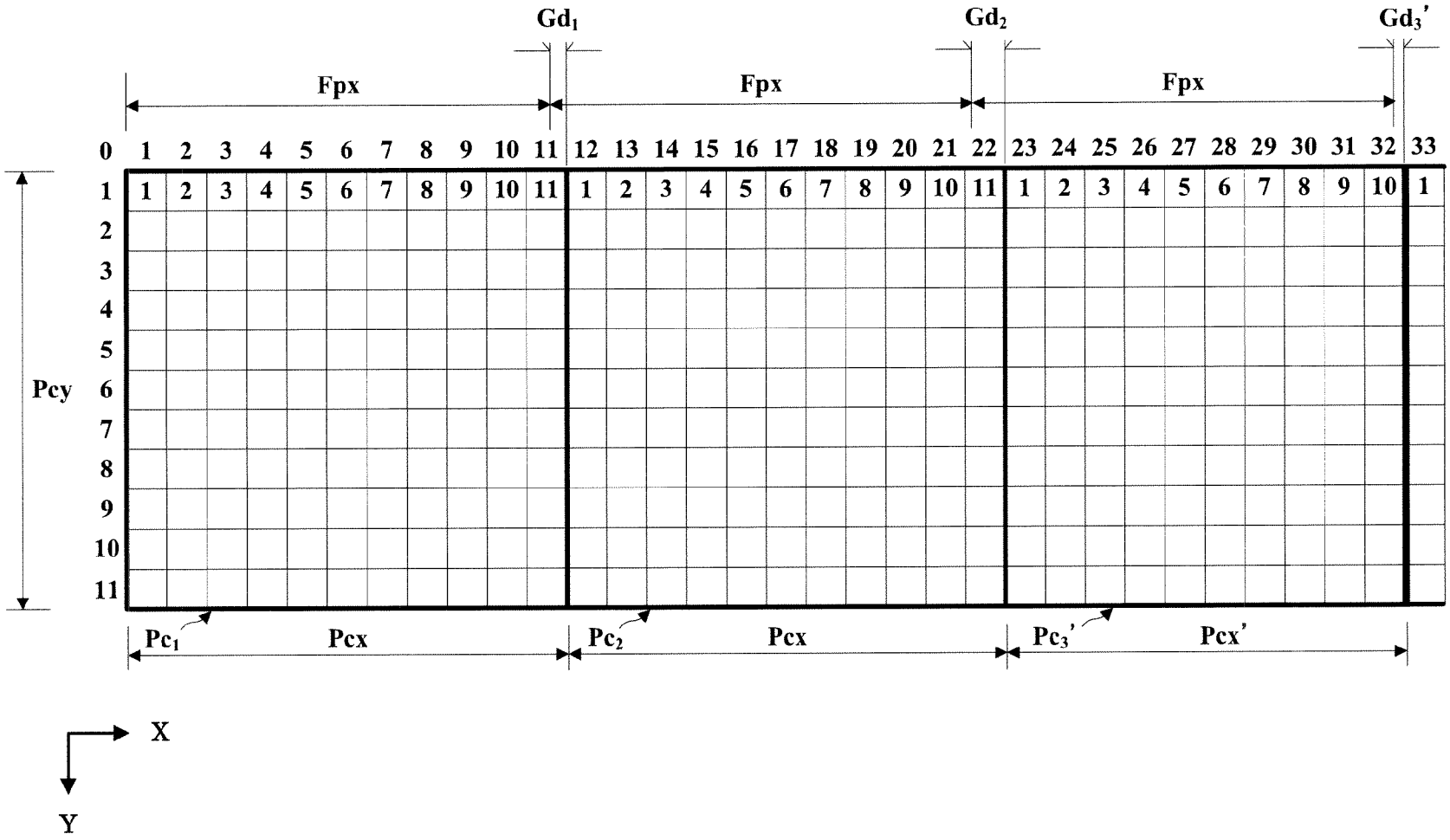
FIG. 6 is an explanatory view showing an arrangement of printing cells relative to the filter pitch.

Next, reference is made to FIGS. 5 and 6. FIGS. 5 and 6 are explanatory views showing an arrangement of printing cells relative to the filter pitch. Width Pcx in X-direction of the printing cells Pc has a value obtained by dividing the filter pitch Fpx by the minimum printing pitch Pm, rounding up a decimal fraction of the quotient, and multiplying the result by the minimum printing pitch Pm. When inputted filter pitch Fpx is 110 μm, Fpx/Pm=10.39≈11. That is, 11 dot areas are included in X-direction in each printing cell Pc corresponding to filter pitch Fpx. Printing cell width Pcx=11·Pm=114.29 μm.

As does width Pcx in X-direction, width Pcy in Y-direction of the printing cells Pc has a value obtained by dividing the filter pitch Fpy by the minimum printing pitch Pm, rounding up a decimal fraction of the quotient, and multiplying the result by the minimum printing pitch Pm. As is width Pcx in X-direction, printing cell width Pcy=11·Pm=114.29 μm. A shift between the filter pitch Fpy and printing cell width Pcy in Y-direction can be complemented by the controller 4 adjusting transport timing of the base material 91 and ejection timing of the inks.

The shift amount calculating unit 36 calculates shift amounts $Gd_n$ between the filter pitch Fpx and printing cells Pc in X-direction. The shift amounts $Gd_n$ are calculated from the following equation:

$$Gd_n=(Pcx-Fpx)+Gd_{n-1} \quad (1)$$

where n is a natural number representing the number of printing cells Pc from the origin of X-direction. The shift amounts $Gd_n$ in this embodiment: $Gd_1$=4.29 μm, $Gd_2$=8.58 μm, and $Gd_3$=12.87 μm.

The shift amount determining unit 37 determines whether a shift amount $Gd_n$ between the filter pitch Fp and an allocated printing cell Pc exceeds the unit dot area. When the shift amount $Gd_n$ is found to exceed the unit dot area, i.e. 10.58 μm, a complementing signal is sent to the printing cell complementing unit 38 and shift amount calculating unit 36. In this embodiment, since $Gd_3$>10.58 μm, the complementing signal is outputted for $Gd_3$.

Upon receipt of the complementing signal, the printing cell complementing unit 38 complements the shift amount $Gd_n$ of the printing cell Pc exceeding the unit dot area by adjusting the number of dot areas included in the printing cell Pc. That is, since the printing cell Pc is formed of 11 dot areas in X-direction, the number of dot areas is reduced by one, thereby forming a printing cell Pc of ten dot areas in X-direction, which makes a shift amount smaller than the unit dot area. Consequently, printing cell Pc3 is formed of ten dot areas in X-direction (see FIG. 6). $Pc_n$ (n being a natural number) represents printing cells Pc counted in order from the origin of X-direction.

Upon receipt of the complementing signal, the shift amount calculating unit 36 calculates a complementary shift amount Gd' which complements the width of the unit dot area from the calculated shift amount Gd. As a complement, for example, the complementary shift amount Gd' is calculated by subtracting the width of the unit dot area from the calculated shift amount Gd. That is, complementary shift amount $Gd_3'=Gd_3-10.58$ μm=2.29 μm. After replacing shift amount $Gd_3$ with the complementary shift amount $Gd_3'$, shift amount $Gd_4$ can be calculated from equation (1) next.

Figure 7:
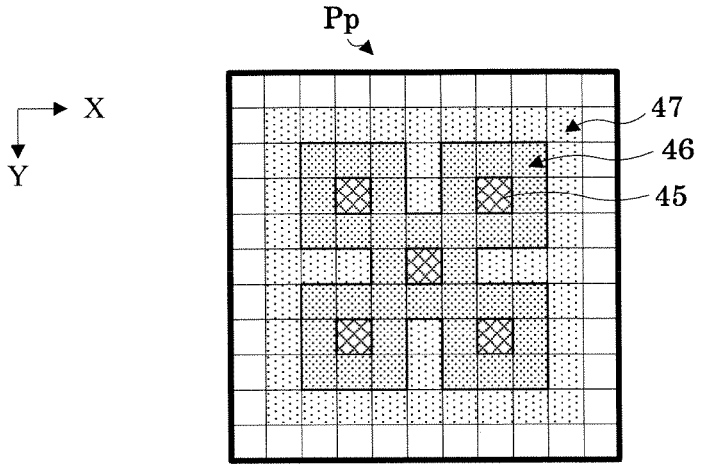
FIG. 7 is an explanatory view illustrating a printing pattern.

Further, a gray scale head is used in this embodiment, which enables the quantity of ink discharged at a time from the nozzles 27 to be adjusted to a plurality of stages. That is, one nozzle 27 located over one dot area Da can apply an ink quantity diffusing to a plurality of dot areas Da. In order to realize this, plural types of printing pattern Pp, as shown in FIG. 7, for example, corresponding to the sizes of printing cells Pc are stored beforehand in the memory unit 39. FIG. 7 is a view showing a printing pattern for the printing cells Pc formed of 11 dots×11 dots. The ink ejected centering on ejection areas 45 spreads to application areas 46 and application areas 47.

Figure 8:
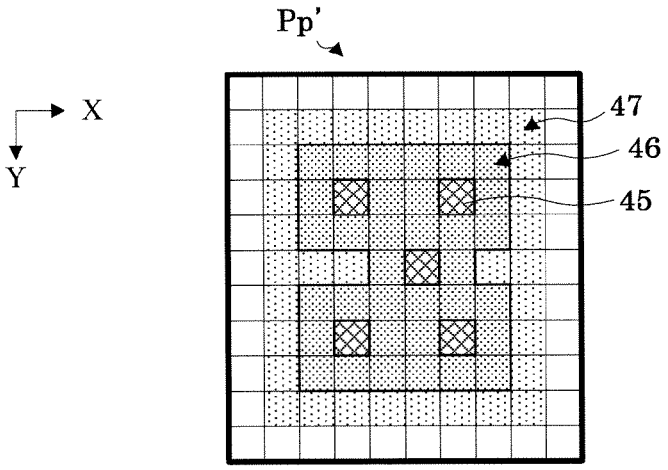
FIG. 8 is an explanatory view illustrating a complementary printing pattern.
Figure 9:
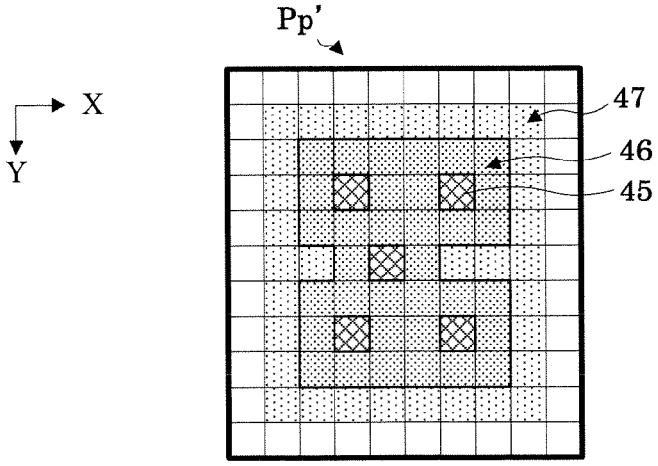
FIG. 9 is an explanatory view illustrating a complementary printing pattern.

The complementary printing pattern creating unit 40 reads a printing pattern Pp stored in the memory unit 39 and corresponding to the size of printing cells Pc, and creates a complementary printing pattern Pp' corresponding to complemented printing cells Pc'. It is desirable to create plural types of complementary printing pattern Pp'. As shown in FIGS. 8 and 9, the complementary printing patterns Pp' are created by reducing non-ejection dot areas from the printing pattern Pp, and the ejection dot areas are arranged asymmetrically in the complementary printing patterns. The complementary printing patterns Pp' shown in FIGS. 8 and 9 are created based on the printing pattern Pp shown in FIG. 7. The created complementary printing patterns Pp' are sent to the printing pattern setting unit 41. As a result of complementary printing, as shown in FIGS. 8 and 9, the ink will spread evenly.

Figure 10:
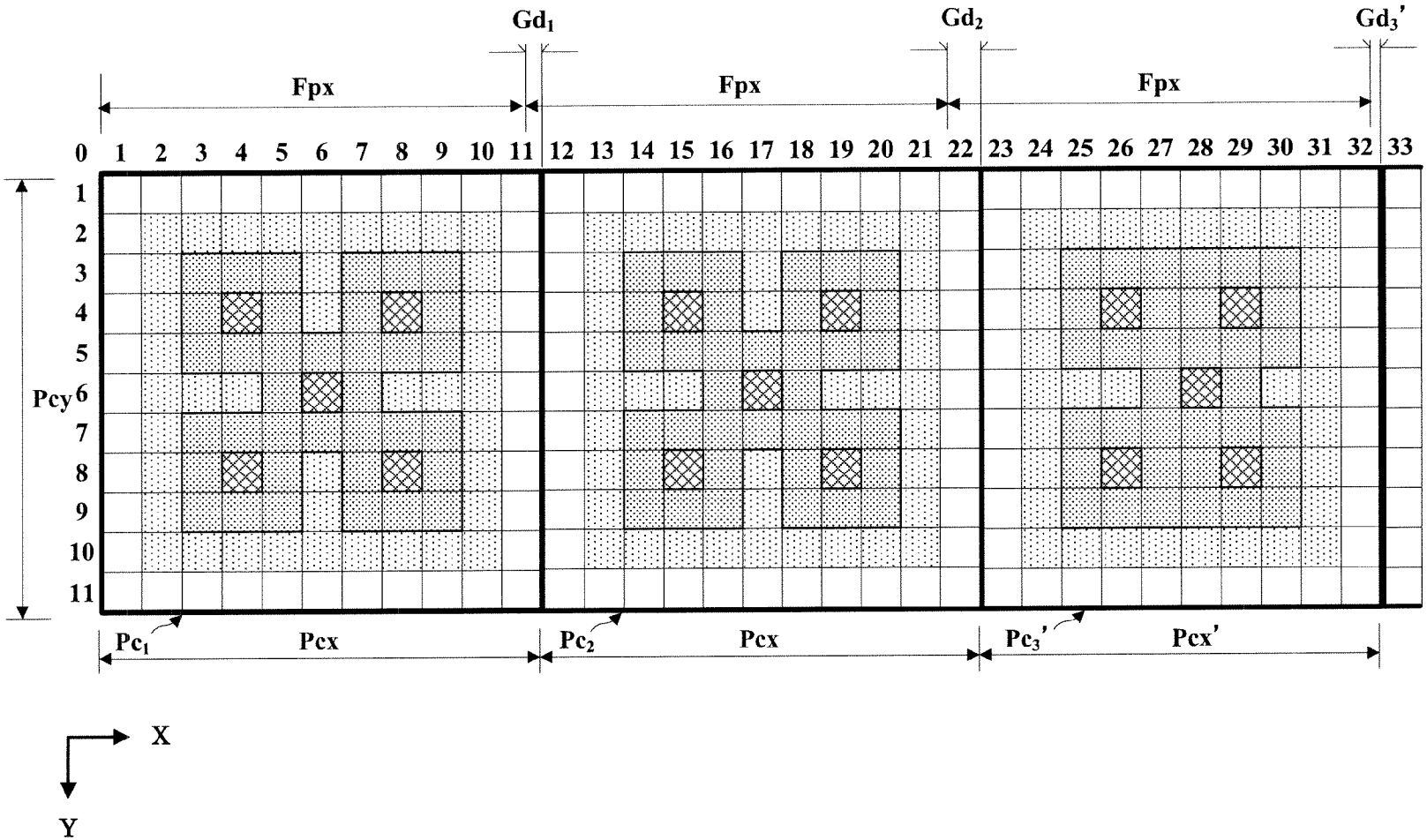
FIG. 10 is an explanatory view illustrating an arrangement of a printing pattern and a complementary printing pattern allocated to the printing cells.

The printing pattern setting unit 41 allocates the printing pattern Pp and complementary printing pattern Pp' to the set printing cells Pc and complemented printing cells Pc', respectively. When there are a plurality of complementary printing patterns Pp', the printing pattern setting unit 41 selects and allocates at random one of the complementary printing patterns Pp' to the complemented printing cell Pc' (see FIG. 10). Since each printing pattern is set to the printing cells in the first row in Y-direction, the same printing pattern as set to the first row may be set to the second and subsequent rows. Image data created by setting each printing pattern to the printing cells is sent to the controller 4.

3. Filter Manufacturing

Figure 11:
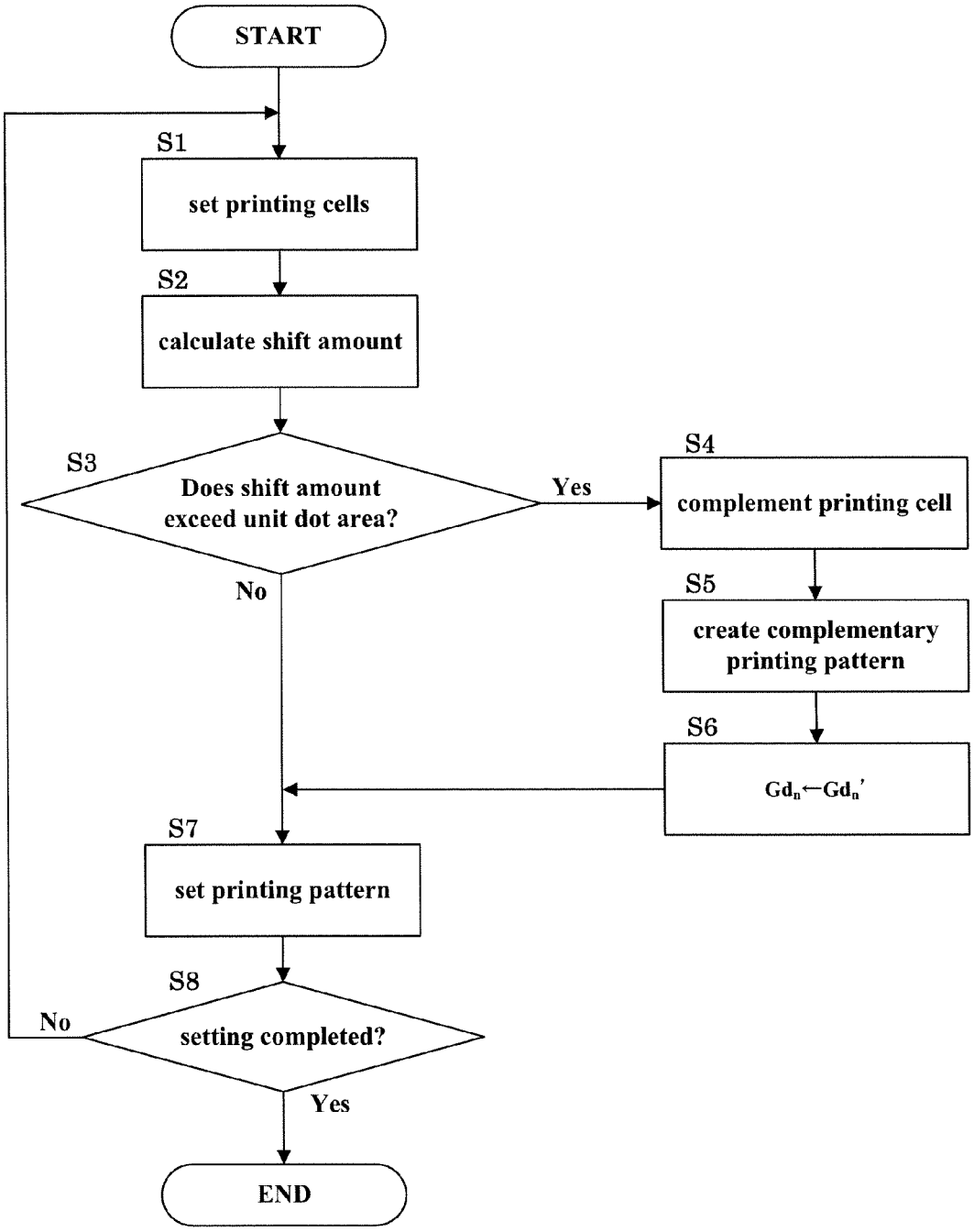
FIG. 11 is a flow chart showing a sequence of manufacturing filters.

Next, filter manufacturing using the foregoing filter manufacturing apparatus 1 will be described with reference to FIG. 11. FIG. 11 is a flow chart showing a sequence of manufacturing filters.

First, the operator inputs pitch Fpx in X-direction and pitch Fpy in Y-direction of the filters to be manufactured. Further, the operator inputs a head resolution. The inputted data is sent to the image data creator 5 through the controller 4. The printing cell setting unit 35 in the image data creator 5, based on the pitch Fpx in X-direction and the head resolution sent from the input unit 6, sets printing cells Pc having an equal number of dot areas Da in the direction (X-direction) perpendicular to the transport direction of the base material 91, and sets printing cells Pcn from the origin of X-direction (step S1). Next, the shift amount calculating unit 36 calculates shift amounts $Gd_n$ between the filter pitch Fpx and printing cells Pc in X-direction (step S2).

The shift amount determining unit 37 determines whether the shift amount $Gd_n$ between the filter pitch Fp and allocated printing cell Pcn exceeds the unit dot area (step S3). When the shift amount $Gd_n$ is found not to exceed the unit dot area, the printing pattern setting unit 41 allocates the printing pattern Pp stored beforehand in the memory unit 39 to the set printing cells Pc (step S7).

When the shift amount $Gd_n$ is found to exceed the unit dot area, a complementing signal is sent to the printing cell complementing unit 38 and shift amount calculating unit 36. Upon receipt of the complementing signal, the printing cell complementing unit 38 complements the shift amount of the printing cell $Pc_n$ exceeding the unit dot area by adjusting the number of dot areas included in the printing cell $Pc_n$ (step S4). For example, the number of dot areas in X-direction in the printing cell $Pc_n$ is reduced by one, thereby making the shift amount smaller than the unit dot area.

Next, the complementary printing pattern creating unit 40 reads the printing pattern Pp stored in the memory unit 39 and corresponding to the size of printing cells Pc, and creates complementary printing patterns Pp' corresponding to complemented printing cells Pc' (step S5). Plural types of complementary printing pattern Pp' are created. The complementary printing patterns Pp' are created by reducing non-ejection dot areas in the printing pattern Pp, and the ejection dot areas are arranged asymmetrically in the complementary printing patterns. The complementary printing patterns Pp' may be created only once, and their subsequent creation may be omitted. Upon receipt of the complementing signal, the shift amount calculating unit 36 calculates a complementary shift amount $Gd_n'$ which complements the width of the unit dot area from the calculated shift amount, and uses it as new shift amount $Gd_n$ when calculating shift amount $Gd_{n+1}$ (step S6).

The printing pattern setting unit 41 allocates a complementary printing pattern Pp' to complemented printing cell Pc' (step S7). When there are a plurality of complementary printing patterns Pp', the complement printing patterns Pp' may be allocated by turns or one pattern may be selected at random and allocated to the complemented printing cell Pc'. Next, it is checked whether all printing cells have been set (step S8). When all printing cells have not been set, the operation returns to step S1, to set printing cell $Pc_{n+1}$ in (+X) direction next to the printing cell Pcn, and set a printing pattern to the printing cell $Pc_{n+1}$. When all printing cells have been set, the creation of image data is ended, and the created image data is sent to the controller 4. Based on the sent image data, the controller 4 controls ejection timing of the inks and transport timing of the base material 91 for the print head 3 and transport mechanism 2, and manufactures the filters. Only the printing method in the direction (direction of the nozzle rows) perpendicular to the transport direction of the base material 91 has been described in this embodiment. As for the filter pitch in the transport direction of the base material 91, printing at a set pitch can be achieved by adjusting the transport speed of the printing medium according to the driving frequency of the head.

According to the filter manufacturing apparatus and filter manufacturing method described above, even if filter pitch Fpx in the width direction and the head resolution are not in agreement, filters can be manufactured by inkjet printing without inclining the inkjet head units 24. Shifts of the filter pitch Fpx can be made smaller than the head resolution, which enables the filters to be manufactured while keeping the filter pitch highly accurate. Further, by setting the printing pattern Pp to the set printing cells, when a gray scale head is used, a proper ink quantity can be ejected to proper discharge positions, thereby to reduce the number of times of ejection. With the complementary printing pattern creating unit 40 creating the complementary printing pattern Pp' corresponding to the complemented printing cell Pc', adjustment can be made to a proper ink quantity to be ejected to proper discharge positions, thereby to print filters appropriately according to the size of the printing cells.

Since the complementary printing pattern Pp is created by reducing the non-ejection dot areas in the printing pattern, density variations of a filter color between printing pattern Pp not complemented and printing pattern Pp' complemented can be inhibited. Further, a pattern with asymmetrical ejection areas is employed as the complementary printing pattern Pp'. Since it has an irregular printing pattern in the arrangement of filters, pitch unevenness can be reduced. With plural types of printing pattern printed at random as complementary printing patterns Pp', since they have generally irregular printing patterns in the arrangement of filters, pitch unevenness can be reduced. The printing pattern Pp has ejection dot areas on diagonal lines in a printing cell Pc, which enables ejected ink to be efficiently diffused within the printing cell.

This invention is not limited to the foregoing embodiment, but may be modified as follows:

(1) The head resolution is 2400 dpi in the foregoing embodiment, but this is not limitative. A head resolution lower or higher than the above may be employed. The higher head resolution provides the smaller shift between the filter pitch Fp and printing cells Pc.

(2) In the foregoing embodiment, the image data creator 5 may further include a pattern adjusting unit. The pattern adjusting unit switches the complementary printing cell Pc' between a forward position and a rearward position with respect to X-direction for every filter row relative to the set printing pattern.

(3) The foregoing embodiment employs an inkjet printer of the multipass type, but may employ an inkjet printer of the one-pass type.

(4) In the foregoing embodiment, when calculating the number of dot areas included in a printing cell Pc, a decimal fraction of the value obtained by dividing the filter pitch Fpx by the minimum printing pitch Pm is rounded up. Instead, the decimal fraction may be rounded down. In the case of rounding down the fraction, when the shift amount Gdn between the filter pitch Fpx in the width direction and the printing cell Pc exceeds the unit dot area, this may be complemented by increasing by one the number of dot areas forming the printing cell Pc in the width direction.

Figure 12:
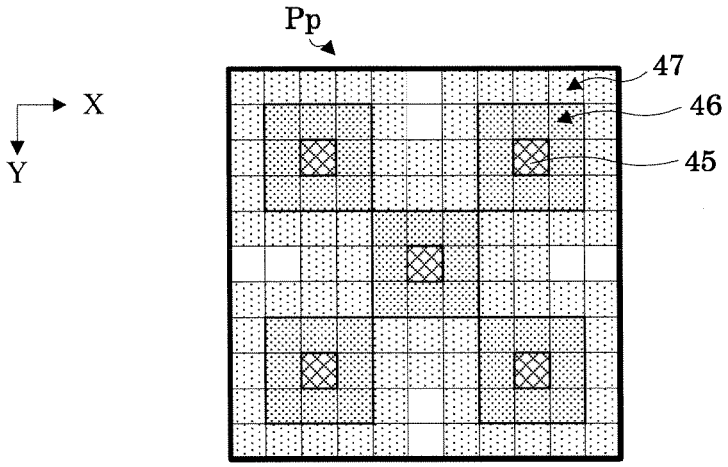
FIG. 12 is an explanatory view illustrating a modified printing pattern.
Figure 13:
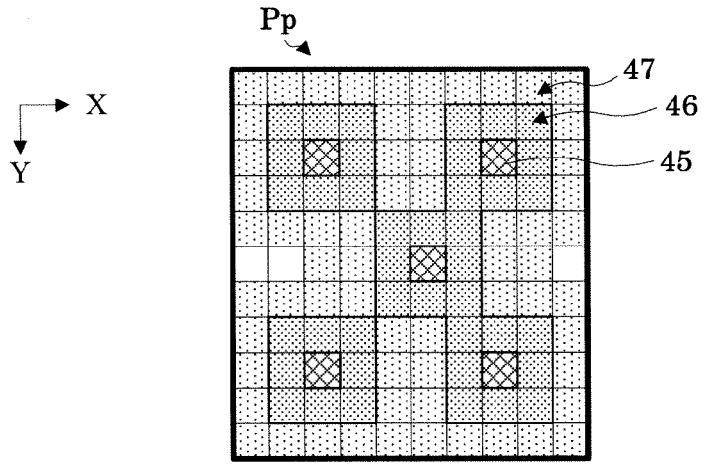
FIG. 13 is an explanatory view illustrating a modified complementary printing pattern.
Figure 14:
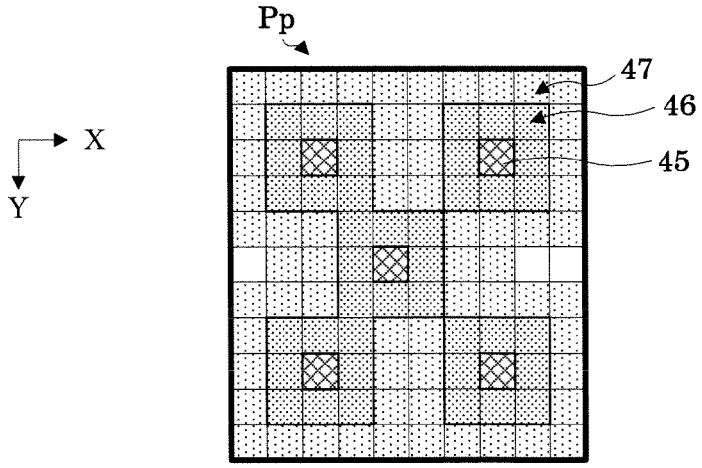
FIG. 14 is an explanatory view illustrating a modified complementary printing pattern.

(5) In the foregoing embodiment, the printing pattern Pp is a pattern where ink does not spread to boundaries of the printing cell. As shown in FIG. 12, this may be a pattern where ink spreads to the boundaries of the printing cell. The application areas can be enlarged by increasing the intervals between the ejection areas 45. As shown in FIGS. 13 and 14, the complementary printing patterns Pp' can also be patterns where ink spreads to the boundaries of the printing cell.

(6) In the filter manufacturing method in the foregoing embodiment, a printing pattern is set whenever a printing cell is set. Instead, after setting all printing cells, corresponding printing patterns may be set, respectively. Printing cells and corresponding printing patterns may be set for each group formed of some printing cells.

This invention may be embodied in other specific forms without departing from the spirit or essential attributes thereof and, accordingly, reference should be made to the appended claims, rather than to the foregoing specification, as indicating the scope of the invention.

What is claimed is:

1. A filter manufacturing apparatus for manufacturing, by inkjet printing, filters arranged at intervals in a transport direction of a printing medium and in a direction perpendicular to the transport direction, the apparatus comprising:

a printing cell setting unit for setting, based on a predetermined filter pitch and a head resolution, printing cells having an equal number of dot areas in the direction perpendicular to the transport direction of the printing material;

a shift amount calculating unit for calculating shift amounts between the filter pitch and the printing cells in the direction perpendicular to the transport direction of the printing medium;

a shift amount determining unit for determining whether shift amounts of the printing cells exceed a unit dot area; and a printing cell complementing unit for complementing the shift amounts of the printing cells exceeding the unit dot area by adjusting the number of dot areas included in the printing cells.

2. The apparatus according to claim 1, further comprising:

a complementary printing pattern creating unit for creating a complementary printing pattern corresponding to the printing cells complemented by the printing cell complementing unit from a predetermined printing pattern to be ejected in the printing cells; and a printing pattern setting unit for allocating the printing pattern to the printing cells and allocating the complementary printing pattern to the complemented printing cells.

3. The apparatus according to claim 2, wherein the complementary printing pattern creating unit is arranged to create the complementary printing pattern by reducing non-ejection dot areas in the printing pattern.

4. The apparatus according to claim 3, wherein the complementary printing pattern is an asymmetrical pattern.

5. The apparatus according to claim 4, wherein:

the complementary printing pattern creating unit is arranged to create plural types of complementary printing pattern; and the printing pattern setting unit is arranged to allocate at random the plural types of complementary printing pattern to the complemented printing cells.

6. The apparatus according to claim 5, wherein the printing pattern has ejection dot areas on diagonal lines in the printing cells.

7. The apparatus according to claim 2, wherein the printing pattern has ejection dot areas on diagonal lines in the printing cells.

8. The apparatus according to claim 3, wherein:

the complementary printing pattern creating unit is arranged to create plural types of complementary printing pattern; and the printing pattern setting unit is arranged to allocate at random the plural types of complementary printing pattern to the complemented printing cells.

9. The apparatus according to claim 8, wherein the printing pattern has ejection dot areas on diagonal lines in the printing cells.

10. The apparatus according to claim 4, wherein the printing pattern has ejection dot areas on diagonal lines in the printing cells.

11. A filter manufacturing method for manufacturing, by inkjet printing, filters arranged at intervals in a transport direction of a printing medium and in a direction perpendicular to the transport direction, the method comprising:

a printing cell setting step for setting, based on a predetermined filter pitch and a head resolution, printing cells having an equal number of dot areas in the direction perpendicular to the transport direction of the printing medium;

a shift amount calculating step for calculating shift amounts between the filter pitch and the printing cells in the direction perpendicular to the transport direction of the printing medium;

a shift amount determining step for determining whether shift amounts of the printing cells exceed a unit dot area; and a printing cell complementing step for complementing the shift amounts of the printing cells exceeding the unit dot area by adjusting the number of dot areas included in the printing cells.

12. The method according to claim 11, further comprising:

a complementary printing pattern creating step for creating a complementary printing pattern corresponding to the printing cells complemented by the printing cell complementing step with a predetermined printing pattern to be ejected in the printing cells; and a printing pattern setting step for allocating the printing pattern to the printing cells and allocating the complementary printing pattern to the complemented printing cells.

13. The method according to claim 12, wherein the complementary printing pattern creating step is executed to create the complementary printing pattern by reducing non-ejection dot areas in the printing pattern.

14. The method according to claim 13, wherein the complementary printing pattern is an asymmetrical pattern.

15. The method according to claim 14, wherein:

the complementary printing pattern creating step is executed to create plural types of complementary printing pattern; and the printing pattern setting step is executed to allocate at random the plural types of complementary printing pattern to the complemented printing cells.

16. The method according to claim 15, wherein the printing pattern has ejection dot areas on diagonal lines in the printing cells.

17. The method according to claim 12, wherein the printing pattern has ejection dot areas on diagonal lines in the printing cells.

18. The method according to claim 13, wherein:

the complementary printing pattern creating step is executed to create plural types of complementary printing pattern; and the printing pattern setting step is executed to allocate at random the plural types of complementary printing pattern to the complemented printing cells.

19. The method according to claim 18, wherein the printing pattern has ejection dot areas on diagonal lines in the printing cells.

20. The method according to claim 14, wherein the printing pattern has ejection dot areas on diagonal lines in the printing cells.

* * * * *